US006112333A

United States Patent [19]

Mazzei

[11] Patent Number: 6,112,333

[45] Date of Patent: Sep. 5, 2000

[54] PROTECTIVE HELMET FOR ANESTHETIZED PATIENT

[76] Inventor: William Mazzei, 9707 Caminito Suelto, San Diego, Calif. 92131

[21] Appl. No.: 09/080,975

[22] Filed: May 19, 1998

[51] Int. Cl.[7] ..... A42B 3/00; A47C 20/02

[52] U.S. Cl. ..... 2/410; 2/9; 128/857; 5/638; 5/643

[58] Field of Search ..... 2/9, 11, 410, 411, 2/414, 417, 424; 128/845, 846, 857, 858; 5/638, 639, 640, 643, 622; 602/17

[56] References Cited

U.S. PATENT DOCUMENTS

| | | | |
|---|---|---|---|
| 1,060,220 | 4/1913 | White | 2/9 |
| 3,337,883 | 8/1967 | Allison | 5/638 |
| 3,729,745 | 5/1973 | Latina | 2/9 |
| 4,024,587 | 5/1977 | Barford | 2/424 |
| 4,504,050 | 3/1985 | Osborne | 5/637 |
| 4,752,064 | 6/1988 | Voss | 5/638 |
| 4,757,983 | 7/1988 | Ray et al. | 5/637 |
| 5,214,815 | 6/1993 | Agbodoe et al. | 5/637 |
| 5,220,699 | 6/1993 | Farris | 5/636 |
| 5,520,623 | 5/1996 | Williams | 602/17 |

*Primary Examiner*—Michael A. Neas
*Attorney, Agent, or Firm*—Donn K. Harms

[57] ABSTRACT

A protective helmet apparatus of modular construction to be worn by anesthetized patients during surgery . The helmet is assembled using one of a plurality of interchangeable helmet casings which is removably attached to one of a plurality of dismountable chin supports. Removable ocular and chin support cushions chosen from a set of interchangeable ocular and chin support cushions are mountable to the interior face of the helmet casing and chin support. The removable cushions contact the allow for optimum sizing of the apparatus to face of the patient providing padding and maximum disbursement of weight and pressure of the head over a wide area of the patient's face and head. The cushions and helmet casing and chin support are modular in design and dimension to be interchangeable with each other thus providing accommodation for broad differences in facial structure and size of patients using them for surgery. Mounts and passages are optionally provided for communicating tubes supplying the patient with life support as well as wiring for sensors monitoring the patient. Additionally, a rotatable handle may be mounted upon the apparatus for use during patient movement on or off of the operating table.

20 Claims, 2 Drawing Sheets

PROTECTIVE HELMET FOR ANESTHETIZED PATIENT

BACKGROUND OF THE INVENTION

1. Field of the Invention

The present invention relates to a safety helmet for cranial protection. More particularly it relates to a modular helmet apparatus constructed of interchanging cooperative components of differing sizes which provide a prophylactic helmet to be worn by patients undergoing general anesthesia to prevent eye, skin, or other nerve damage from prolonged pressure upon areas of the head as well as to provide a safer manner for cranial manipulation during surgery.

2. Prior Art

Surgeries upon patients in the prone position present a number of patient care challenges to the anesthesiologist and surgical staff. Once a patient undergoing a surgery requiring general anesthesia is anesthetized, that patient is essentially in a coma like state. In such a state, noxious stimuli to the patient's body and skin, such as pressure or pain, which would normally cause an awake patient to move to relieve the stimulus, no longer causes such a reaction. Consequently, patients under general anesthesia are especially threatened by a number of factors, other than the surgery itself, which arise during such surgical procedures.

One hazard which requires constant vigilance by the surgical staff to protect against injury is the threat of eye damage. Inadvertent pressure upon the ocular structures of a patient for just a matter of minutes can cause extreme damage or blindness to the eye. As noted above, because the anesthetized patient is in a coma like state, the discomfort of facial compression upon the eye, which would normally cause an awake patient to move and relieve that pressure, fails to alert the anesthetized patient. Care must be taken by an ever alert surgical staff to inspect for possible pressure points about the ocular structures of the patient and to move the patient's face to prevent eye damage.

Other compression injuries can occur to the anesthetized patent's forehead and chin areas. Here again, the constant pressure upon those areas, caused by the weight of the patients own head, if not relieved by movement of the face to allow blood flow thereto, can cause localized ischemia to the chin and forehead area. Since the anesthetized patient does not react to the body's cues of discomfort preceding injury, the risk of harm in a matter of minutes to these areas is great.

Currently, there are a number of conventional methods to support the head and protect the eyes and face of a patient from compression injuries during surgery which require the patient to be placed in a prone, face down, position for the long periods of time involved in surgery. One method conventionally used is placement of the patient's head and face in a horseshoe shaped frame supporting a foam pillow which holds the patients face off of the operating table in a supported manner. The patient's eyes are generally taped shut when such a structure is used to keep them from contact with the foam and to prevent eye fluid drainage. This frame and pillow support however has inherent hazards of its own in that it cannot distribute pressure maximally over the surface of the head. Further, great care must be taken by the anesthesiologist and staff to make sure that any anesthetic equipment, such as endotracheal tubes, esophageal stethoscopes, or electronic sensing devices, are not dislodged or disrupted by gravity or patient positioning during the term of the surgical procedure. Such disruption or dislodgement of surgical equipment can cut off the air supply to the patient or lead to inaccurate readings by monitoring equipment.

Another method is simply to place the patient's face sideways on a pillow or towel located upon the surgical table. However, this method suffers from the danger of tubing collapse due to the patient's head weight, and even a face or eye supported by a foam pillow may be damaged if the pressure is uneven and remains on one area too long. Further, the placement of the patient's face on a towel requires the head to be turned one way or the other, placing pressure on one side of the face which, as noted earlier, subjects the patient to the potential of injury. Additionally, blood flow through the veins and arteries of the neck may be impaired by this twisted fashion of head support. Hazards to the patient increase if the surgery requires a face down posture because the danger of tube collapse from pressure or bending increases with the tubes entering the patient's body through the mouth or nose being compressed between the patient's face and the operating table. With the entry points to the head out of view, such constrictions of the tubes also remain out of sight.

A further challenge facing surgical teams during surgery on anesthetized patients is the seemingly simple task of rolling the patient over from a supine position to a prone position on the operating table or from a cart onto the operating table. Generally, the patient at this point in the surgical procedure is already intubated, asleep, and basically "dead weight." In this physical state, the patient is at great risk of injury during the roll over procedure, especially to the neck area. Additionally vexing to the surgical staff is the fact that the patient, with tubes exiting the mouth and/or nose, must be rolled over, without disturbing the tubes and without injuring the neck. Concurrently during the roll over procedure, the surgical staff must plan ahead so that when the patient is placed face down on an operating table, the face is properly aligned with, and inserted upon or into the pillow, already located upon the table. This insertion of the face into the pillow is conventionally done without the benefit of a pre surgery fit to make sure the face and pillow and frame mate in a manner that will accommodate the patient for the term of the surgery and protect the face from compression injury. Heads and faces being quite different amongst people in general, an optimum fit between face and pillow is achieved only a small percentage of the time. Once in this prone position, the danger of injury remains constant and continued and consistent vigilance by the surgical staff is required to ascertain, that in fact, the patient's airways are open, the eyes are not compressed, and the face is not being subjected to pressure at any point for a duration sufficient to cause nerve damage.

Finally, when the operation is over, the patient must again be moved off of the operating table and is generally rolled over onto a gurney in a reverse roll over procedure. Still anesthetized, the patient is at great risk of injury to the neck if the head is not adequately supported and manipulated during this roll over process.

Still further, if an emergency develops while the patient is in the face down prone position, requiring the patient to be rolled to the supine position, valuable life saving time can be lost trying to upright the patient without injury to the neck, and without crimping the airway supply tubing and monitoring equipment communicating through the nose and mouth of the patient.

Further, patient size is also a factor in the fitting of facial and head support. A child may have a very small face and head and an adult a large one. Conversely, a large child may have a head and face requiring support in areas much different from a small stature adult.

U.S. Pat. No. 5,220,699 (Farris) teaches an inflatable pillow mounted inside a mask for variable support of differing sized patients. However Farris requires the use of an inflatable chamber which as taught is inflated once the patient has already been rolled to the prone position. It requires an air inflation device to function and lacks the ability for an easy installation prior to surgery and will not function without compressed air.

U.S. Pat. No. 4,400,820 (O'Dell) teaches an apparatus using pads and having a "T" shaped void which may be used in combination with a support structure to hold the patient's head. However, O'Dell does not allow for pre-fitting and pre-installing the protective device prior to surgery and does not aid in protecting the patient during roll over on and off the table.

U.S. Pat. No. 5,214,815 (Agbodoe) teaches a surgical headrest with a removable foam pad; however, Agbodoe does not provide any manner to pre-fit and install the device on the patient prior to being asleep and it mounts to the table and is intended for use after roll over thereon.

U.S. Pat. No. 4,757,983 (Ray) features a pair of cushions attached to a horseshoe shaped frame for surgical head support. However Ray also suffers from an inability to pre-fit and install the device on patients prior to surgery while they are awake as well as lacking any protective ability during dangerous roll over onto the table.

As such, there exists a need for a support device that is easily modified to fit a variety of patients of differing size, that may be pre-fit and pre-attached to the patient prior to surgery while the patient is alert and able to ascertain the comfort or discomfort level of the device. Further such a device should provide an additional manner to support the head and maximally diffuse pressure over a large area, during surgery, as well as during the hazardous movement of the patient prior to and after surgery.

SUMMARY OF THE INVENTION

The present invention relates to a new and improved protective helmet apparatus for patients undergoing general anesthesia during surgery. The device is best made of modular construction allowing for the assembled helmet to fit a variety of different sized patients using variable dimensioned cushion inserts which are locatable in a plurality of interchangeable light weight helmet casings and chin supports which are also interchangeable and also available in differing dimensions.

The device is especially useful in that it allows for pre-fitting of the patient while the patient is awake and alert using modular pads of differing facial dimensions and having a rear or mask side dimension configured to fit into a registered position in the mask or face plate. The device having the pre-fitted cushions or pads mounted into the mask, evenly diffuses pressures on the face of the wearer and may be worn into surgery such that the surgical team need not worry about trying to fit the patient with pillows or pads in a table mounted frames after the patient is asleep.

Once in surgery the best embodiment of the device features a hinged or optionally removable lower chin support which is moveable from a first position in operable contact with the helmet casing to a second position out of such contact, thus allowing the surgical team easy access to the entire face and mouth area for insertion of required tubing into the patients mouth and/or nose. The chin support is thereafter reinstalled to provide lower chin support with the entire helmet being worn by the patient for the rollover procedure on and off the table to protect the patient from injury during the course of the surgical procedure.

As the device may be pre-fitted for optimal weight diffusion and comfort and can be worn during the movement of the patient on and off the operating table, the surgical team is relieved on concerns of whether the device to hold the face and head actually fits the patient. Further, an optional rotating handle upon the top of the helmet provides a handy gripping point for the head for the surgical team to help prevent neck injury during roll over of the patient on and off the table. By placement of a hand on the face of the mask and another on the rotating handle, smooth and continual support may be provided to the neck and head area when the patient is being rolled over on or off of the operating table.

An object of this invention is to provide a helmet which prevents injury due to ocular compression during surgery by minimizing ischemic damages through maximal diffusion of pressure about the patient's head.

Another object of this invention is the provision of a protective helmet for use during surgery which allows for pre-fit of the patient prior to surgery while the patient may comment on the comfort or discomfort level of the device.

A further object of this invention is to provide a protective helmet for surgery which provides a chin support to the patient which is easily removable by the surgical team for insertion of required devices into the mouth and nose of patient and thereafter easily reinstalled.

An additional object of this invention is the allowance of easy access to the face of the patient during an emergency by providing a removable chin support.

A further object of this invention is the provision of a handle for the surgical team to grip and provide neck and head support during roll over of the patient on or off the operating table.

Another object of this invention is the provision of a protective surgical helmet of modular construction which allows for positioning of different sized facial pads and components into the helmet for different sized patients.

An additional object of this invention is providing an easily sterilized protective helmet through the use of easily sterilized inserts or inexpensive throw away inserts removably mountable inside an easily sterilized helmet shell.

A still further object of this invention is to concurrently provide easy viewing of the eyes and mouth area of the patient while the device is mounted upon the patient.

Further objects of the invention will be brought out in the following part of the specification, wherein detailed description is for the purpose of fully disclosing the invention without placing limitations thereon.

BRIEF DESCRIPTION OF DRAWING FIGURES

DETAILED DESCRIPTION OF THE PREFERRED EMBODIMENT OF THE INVENTION

Figure 1:
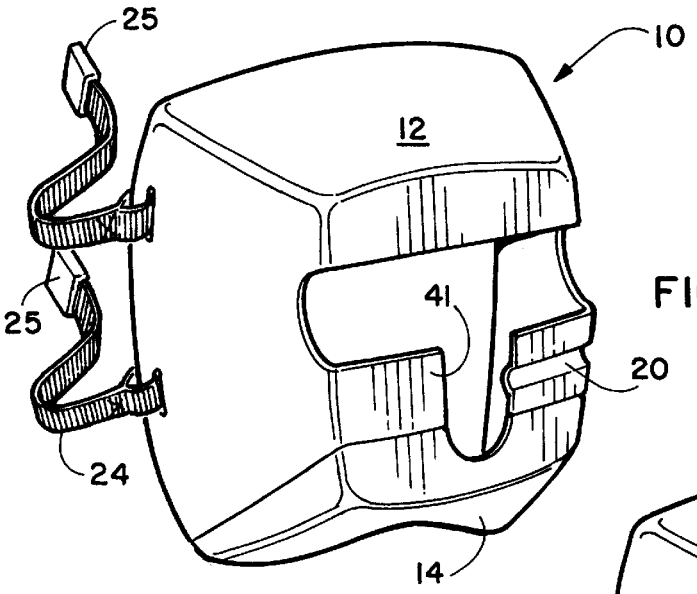
FIG. 1 is a perspective frontal view of the protective helmet device showing the chin support in a mounted position.
Figure 2:
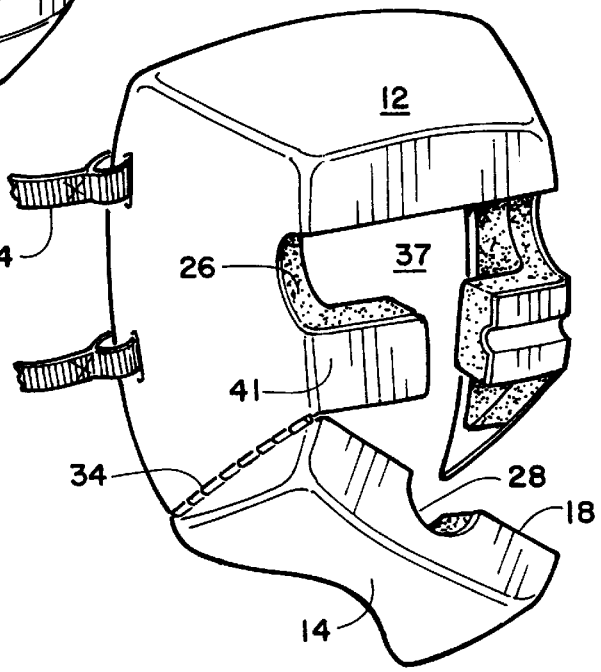
FIG. 2 is a frontal view of the device featuring the hinged repositionable chin support.
Figure 3:
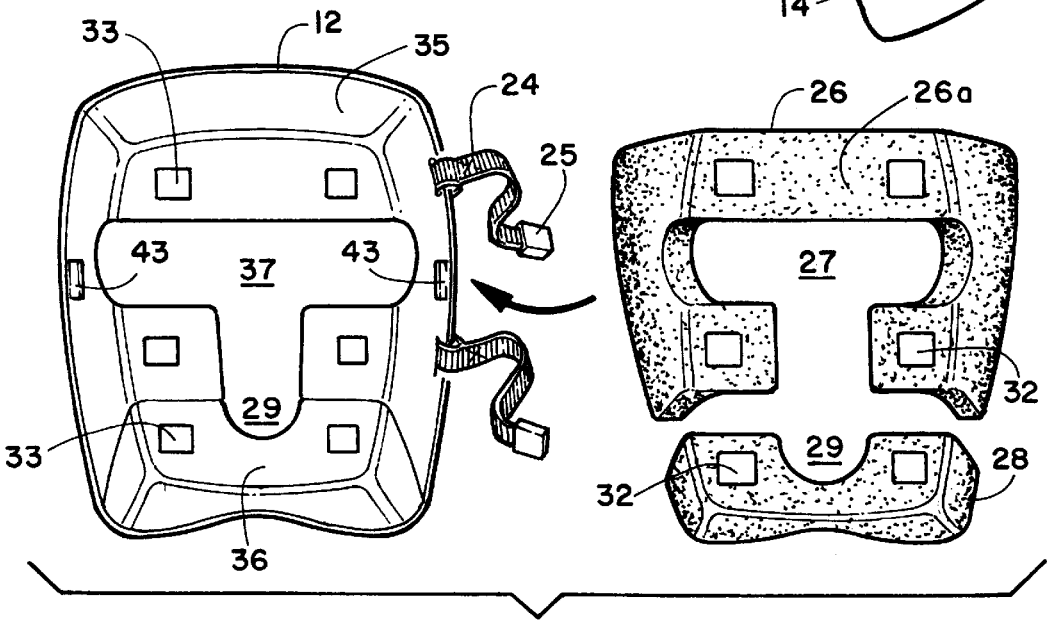
FIG. 3 is a rear exploded view of the protective helmet device showing the modular pads for the ocular area and chin support.
Figure 4:
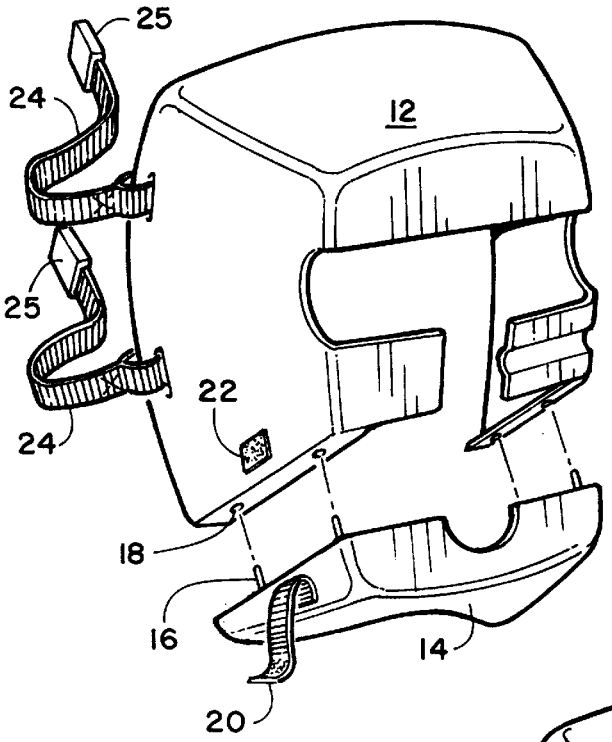
FIG. 4 shows the helmet with detachable and repositionable chin support portion.
Figure 5:
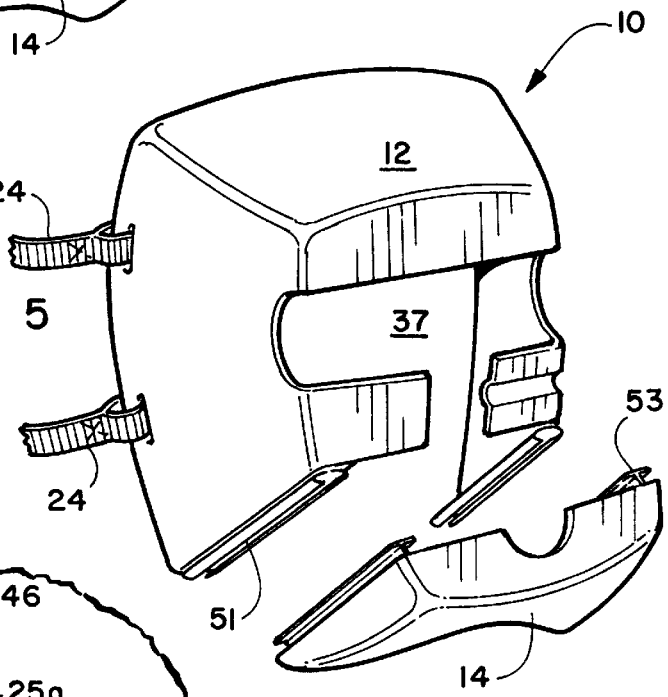
FIG. 5 depicts the helmet with detachable and repositionable chin support slidably mountable to the helmet.
Figure 6:
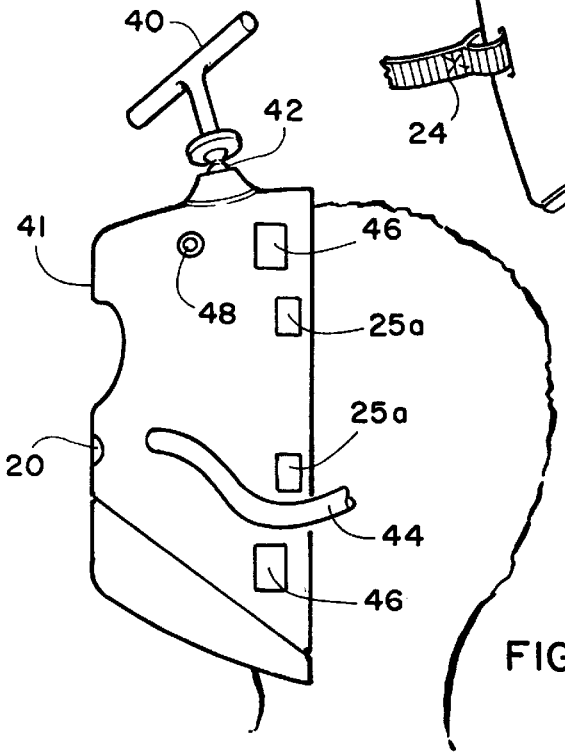
FIG. 6 depicts a side view of the apparatus showing the optional handle side grip and the flat face for secure positioning on the surgery table.

Referring now to the drawings, FIG. 1 depicts a preferred embodiment of the modularly assembled protective surgical helmet apparatus 10 featuring the helmet casing 12 which is best made from a substantially rigid but easily molded material such as plastic. The plastic casing should also be resistant to the heat or chemicals sufficient to allow for sterilization between uses. The modular version of the helmet casing 12 mates with a chin support 14 using conventional registering mating positioners such as registration pins 16 which correspond to apertures 18 upon the helmet casing 12. Of course the registration pins 16 and apertures 18 might be reversed in positioning or other conventional means of registration and dismountable attachment may be used to achieve a properly aligned mounting of the chin support 14 to the helmet casing 12. Alternatively, the chin support 14 can be slidably mounted to the helmet casing 12 using a cooperating pair of slide mounts 53 and 51 depicted in FIG. 5 wherein the chin support 14 with one half of the slid fastener 53 would be lined up with the helmet casing 12 and cooperating slide mounts 51 and 53 and thereupon the chin support 14 would slide onto the helmet casing 12 by pushing it into position and interfacing the cooperating slide mounts 51 and 53. In certain instances the helmet casing and chin support might also be formed as one piece for surgeries where removal of the chin support 14 is not a major consideration, however, the design featuring the helmet casing 12 and swinging or dismountable chin support 14 using cooperating slide mounts 51 and 53 or registration pins 16 and 18 with fasteners, along with variable sized cushions is the current best embodiment of the helmet apparatus offering the most convenience and as such would be most desirable.

Cooperating fasteners 20 and 22 such as hook and loop fabric as used in the current best mode of the invention, are used to maintain the chin support 14 in operative contact in a first position wherein it is in a removably fixed position upon the helmet casing 12, however, other conventional mating fasteners such as plastic or metal releasable locking fasteners can also be used and are anticipated. Cooperating fasteners 20 and 22 would also be used to maintain the hinged chin support 14 and slidable chin support 14 in the first position of operable and registered contact with the helmet casing 12 although in the case of the slidable version friction alone in the cooperating slides may be sufficient to releasably hold the chin support 14 in proper contact with the helmet casing 12.

The dismountable chin support 14 may also be attached to the helmet casing 14 at one end using a conventional metal or plastic hinge fastener 34 such that the chin support 14 will swing away from its first position in operative contact in a registered mounting with the helmet casing 12. This embodiment allows for easy access to the patient's facial area during surgery or emergencies while maintaining the chin support attached to the helmet casing 12 when swung to the second position out of operative contact with the helmet casing so as to avoid loss of the chin support 14.

Straps 24 having cooperating fasteners 25 at their distal ends securable to mating cooperating fasteners 25*a* upon the helmet casing 12 are used to operatively secure the helmet casing 12 upon the face of the patient once the properly sized ocular cushion 26 has been removably mounted into the helmet casing 12.

The ocular cushion 26 and chin cushion 28, if to be reusable, are best made of a closed cell foam material or a similar material which does not absorb fluid easily to allow the cushions to be sterilized in the conventional fashion for reuse. However, for ease of use and to maintain a highly sterile field about the patient, disposable ocular cushions 26 and chin cushions 28 may be a more desirable factor since they could be used once and replaced after each operation. Optionally, for an even more custom fit to individual patients is desirable, the ocular cushion 26 and chin cushion 28 may also be made inflatable with gas or fluid or silicone or other gel such that they may be adjusted in size and flexibility by filling them with a gas or liquid into the cushions through a sealable orifice communicating through the wall of the cushion.

The ocular cushion 26 may be made in a set of multiple cushions 26 varied in dimensions of both thickness and width and have variable sized and located ocular apertures 27 therein to best accommodate the size and facial structure of a variety of differing sized individuals using the same helmet casing 12. The chin cushions 28 may also be from a set of such cushions 28 varied in dimensions of both thickness and width to achieve optimum fit on individual patients. Further, by varying the dimensions of the cushions 26 and 28 and the size of the apertures 27 and 29 therein, and matching them to the properly sized helmet casing 12 to be assembled with chin support 14, virtually any adult or child may be fitted to wear the helmet casing 12 comfortably with optimal support of the facial structure of the cranium and maximal diffusion of pressure and weight about the face and sides of the patient's head to obviate injury to the eyes and face and nerves.

The ocular cushion 26 and the chin cushion 28 are attached to the helmet casing 12 and repositionable chin support 14 respectively, using corresponding mounts 32 such as hook and loop fabric or adhesive pad fasteners mounted on the cushions 26 and 28 in positions to contact corresponding mounts 33 on the respective interior surfaces 35 and 36 of the helmet casing 12 and chin support 14. However, adhesive mounting does not require using cooperating mounts 32 and 33. In this manner using adhesion, adhesive, two-sided tape, adhesive pads, adhesive covered by an easily removable paper, or similar conventional adhesive attachments can be placed between the cushions 26 and 28 and the inside faces of the helmet casing 12 and chin support 14. When using a disposable form of cushions 26 and 28, adhesive can be mounted upon the helmet side of the cushion surface for an easy mount of the cushions into the helmet casing 12 and repositionable chin support 14. Such a disposable form of cushions 26 and 28 would be kept sterile inside a sealed wrapper in the conventional manner and removed and mounted to the inside faces 35 and 36 of the helmet casing 12 and chin support 14 respectively, using conventional peel and stick adhesive pads positioned upon the surface of the cushions to attach them to the helmet interior.

The device 10 offers great utility to the user since it is capable of using either disposable or reusable cushions for cushions 26 and 28 or combinations thereof. Where disposable cushions are desirable due to their ease of use and lack of the need for sterilization, just the helmet casing 12 and chin support 14 need be sterilized. However, a reusable form of cushions 26 and 28 may also be used in the device 10 where the cushions are sterilized between use. Or, a combination of reusable and disposable cushions 26 and 28 may be used should such be desired or required if a reusable cushion is lost.

In use, the patient would be measured for the optimum helmet casing 12 size which would be chosen from a plurality of available interchangeable helmet casings and chin support 14 of proper size which would be chosen from a plurality of interchangeable chin supports capable of attachment to said casing 12. Also chosen to accommodate differing facial and head dimensions would be the properly dimensioned cushions 26 and 28, from a set of interchangeable cushions, to allow the patient maximum comfort and diffusion of pressure about the surface of the face and side of the head. The patient could be given samples of the different sizes of cushions 26 and 28 from a set of variable dimensioned cushions 26 and 28 to which the patient would give input as to the best possible fit or a medical technician might also help determine the optimum casing and cushion dimensions with or without the patient's input. This availability of an assortment of cushions and assembled helmet sizes allows for a modular system of helmet casings 12 and attachable chin supports 14 assembled to the helmet, to be used in conjunction with the desired dimension of cushions 26 and 28, also from a set of such cushions of differing dimensions, to achieve the optimum fit on a variety of sizes of patient heads.

Once the optimum dimensions of the cushions 26 and 28 are determined, yielding a comfortable fit and maximal pressure distribution about the face and sides of the head, the cushions 26 and 28 are removably mounted into the interior of both the helmet casing 12 and chin support 14 using the aforementioned adhesive or fastener mounts 32 located upon the cushions which attach to cooperating mounts 33 which are positioned upon the helmet casing 12 and chin support 14 respectively. This is accomplished in a manner to allow for the mounting the cushions 26 and 28 into the cooperatively configured inside faces 35 and 36 of the helmet casing 12 and chin support 14 respectively.

The inside surface 35 of casing 12 features a casing ocular aperture 37 and the chin support 14 has a chin support aperture 39. When properly positioned in the cooperating inside faces of the helmet and casing 12, the aperture 27 in the ocular cushion 26 will be relatively in line with the casing ocular aperture 37 such that the eyes and nose and some surrounding portions of the patient's face may be easily viewed through the ocular aperture 37 when the device 10 is being used during surgery after being positioned upon the patients face. The ocular cushion aperture 27 might best be made slightly larger than the casing ocular aperture 37 to allow for easy mounting of the ocular cushion 26 into the casing 12 to allow for the patient's eyes and surrounding skin area to be viewed through the casing ocular aperture 37 and relatively in-line cushion ocular aperture 27. Where the casing ocular aperture 37 wrap around to the side of the casing 12 the ocular cushion aperture 27 would also wrap around in a relatively in-line position with the ocular casing aperture 37. This in line relationship of apertures creates a viewing passage communicating through the helmet casing 12 and cushion apertures 37 and 27 thus revealing the patient's temple area of the head in addition to the ocular area of the face and the nose. This in line relationship of the apertures of the pad 26 and 28 with the casing apertures 37 and 28 also allow for the passage of conventionally used tubes through the in line apertures into the patient's nose and/or mouth for providing life support during the operation. Further, the cavity formed by the in line cushions 26 and 28 attached to the helmet casing 12 and chin support 14 gives protection to these tubes at the critical entry and exit positions on the patient at the nose and mouth such that the tubes, inside the cavity, will not bend to a point where flow therethrough is interrupted with possible life threatening consequences to the patient. For additional utility, optional tube passages 44 communicating a tubular passageway from the interior of the device 10 to the exterior, can provide for communication of tubes or sensing device wires therethrough to the patient. Exterior mounted optional tube positioners 46 of hook and loop fabric or other type of fastener suited to the job, can be optionally mounted upon the exterior of the device 10 to hold tubing and/or wires for monitoring the patient operatively therein during surgery. Snap on fasteners may also be optionally attached at the exterior of the device 10 to hold tubing and the like. By providing optional strategically placed snap mounts 48 the snap on fasteners may be placed in differing positions about the exterior to hold the tubing and/or wiring required for certain surgical procedures in place and out of harms way.

The chin support aperture 39 lines up with the bottom of the ocular aperture 37 when the dismountable chin support 14 is operably mounted to the helmet casing 12. The chin support aperture 39 allows for viewing and access to the lower mouth area of the face of the patient with the chin of the patient being supported by the chin aperture 29 in chin cushion 28 removably attached to the inside surface 36 of the chin support 14.

Added utility is provided by the device 10 operably mounted to the face of the patient with the relatively flat frontal surface 41 of the device 10. This frontal surface 41 being flat like that of the top surface of a conventional operating table, allows for a stable support of the patients face inside the properly mounted device 10 when the frontal surface 41 is placed upon the operating table. For especially stable maintenance of the patient's head when in a sideways position a second side flat surface 43 may be located on one or both sides of the device 10.

The ocular aperture 37 may also be enlarged and extended around the flat frontal surface 41 to the side area of the casing 12 providing a clear view of the patients eye socket area from the side of the device 10 whether the patient is in a face down position relative to the operating table or sideways thereto.

During times of moving of the patient for roll over or off of the surgical table and onto a gurney, an optional top handle 40 attached to the top area of the helmet casing 12 portion of the assembled device 10 allows medical personnel a solid griping point for providing head and neck support to the patient while being rolled over or otherwise moved. By holding the patient's neck with one hand and the handle 40 in the other, essential support can be provided to avoid injury to the anesthetized patient. A roller or ball or other conventional bearing 42 can also be placed at the base of the handle 40 should easy rotation of the handle 40 be desired during use. Such a rotation of the handle 40 on the bearing 42 allows for a smooth roll over of the patient with the patient's neck concurrently supported, thus minimizing possible neck injuries during roll over and other hazardous patient relocation procedures.

Additional utility in the disclosed apparatus herein is provided by the insulating factor provided to the patient wearing the surgical helmet 10 and cushions 26 and 28 when mounted upon the face of the patient during a surgical procedure. Operating rooms are conventionally kept quite cold to keep medical personnel and surgeons cool and alert during surgical procedures. The patient however is generally unclothed during such procedures and can suffer discomfort from the overly cool environment of the room. The cushions 26 and 28 form to the face of the patient and are mounted upon the inside surface of the surgical helmet 10 which encompass the face and part of the sides and top of the head of the patient. The result being that the face, sides, and top of the patient's head are insulated from the cool room temperature, helping to keep the patient warmer in the unnaturally cool environment of the operating room.

Further utility is also provided by this surgical helmet device 10 through the use of optional slot passages 21 located in the face of the device for positioning of tubes therein. During a surgery requiring the patient to lay face down, tubes providing breathing supplies to the patient may be positioned in a slot configured to allow the tube to recess therein such that the tube will not collapse when the patient is face down and the tube is between the table and the face 41 of the device 10. Such a slot passage or multiple slot passages 21 may be positioned about the face of the helmet in other locations than shown.

While all of the fundamental characteristics and features of the protective helmet for an anesthetized patient invention have been shown and described, it should be understood that various substitutions, modifications, and variations may be made by those skilled in the art without departing from the spirit or scope of the invention. Consequently, all such modifications and variations are included within the scope of the invention as defined by the following claims.

What is claimed is:

1. A protective helmet apparatus providing patient cranial support during surgery, assembled from modular cooperatively engageable components of differing dimensions for achieving optimum fit and pressure diffusion upon face of the intended helmet wearer comprising:

a modular helmet, said modular helmet configurable in dimensions by assembly of said modular helmet from a collection of interchangeable helmet components, said collection of interchangeable helmet components varying in size and comprising:

a helmet casing having an interior surface and an exterior surface;

at least one ocular aperture in said helmet casing communicating therethrough;

a chin support having an interior surface and exterior surface, said chin support configured to cooperatively engage said helmet casing;

means for removable engagement of said chin support to said helmet casing;

ocular cushioning means removably attachable to said interior surface of said helmet casing, said ocular cushioning means having an ocular slot therethrough;

chin cushioning means attachable to said interior surface of said chin support; and means for releasable securement of said modular helmet to the head of the intended wearer of said modular helmet, and wherein, said modular helmet may be assembled from said collection of interchangeable helmet components to achieve optimum comfort and diffusion of pressure on the face of the wearer which contacts said ocular cushioning means and said chin cushioning means, by varying the sizes of said interchangeable helmet components assembled into said modular helmet.

2. The protective helmet apparatus as defined in claim 1 wherein said attachment means for removable attachment of said chin support to said helmet casing comprises:

a hinge attached to said helmet casing and said chin support;

said chin support swingable on said hinge from a position in operable contact with said helmet casing to a second position out of contact with said helmet casing; and a releasable fastener, said releasable fastener having a secured position maintaining the attachment between said chin support and said helmet casing, and a disengaged position wherein said chin support is separable from said helmet casing.

3. The protective helmet apparatus as defined in claim 1 wherein said attachment means for removable attachment of said chin support to said helmet casing comprises:

a first pair of cooperating slide mounts upon said helmet casing;

a second pair of cooperating slide mounts upon said chin support; and said first pair of slide mounts cooperatively engageable with said second pair of slide mounts when slid thereon, whereby said chin support is mounted to an operative position upon said helmet casing by slidable engaging said first pair and said second pair of slide mounts.

4. The protective helmet apparatus as defined in claim 1 wherein said attachment means for removable attachment of said chin support to said helmet casing comprises:

cooperating registration positioners mounted on both said chin support and said helmet casing, said cooperating registration positioners located for mutual cooperative engagement when said chin support is operatively positioned upon said helmet casing; and cooperating releasable fasteners upon both said helmet casing and said chin support to removably secure said chin support in position upon said helmet casing.

5. The protective helmet apparatus as defined in claim 4 wherein said cooperating releasable fasteners are hook and loop fabric.

6. The protective helmet apparatus as defined in claim 4 wherein said cooperating releasable fasteners are metal latches.

7. The protective helmet apparatus as defined in claim 1 wherein said ocular cushioning means is made from foam material.

8. The protective helmet apparatus as defined in claim 1 wherein said ocular cushioning means is one of a set of liquid filled flexible containers of varying dimensions.

9. The protective helmet apparatus as defined in claim 1 wherein said ocular cushioning means is removably attachable to said helmet casing using adhesive located upon said ocular cushion.

10. The protective helmet apparatus as defined in claim 1 wherein said ocular cushioning means is removably attached to said helmet casing using hook and loop fabric attached to said helmet casing and said ocular cushioning means.

11. The protective helmet apparatus as defined in claim 1 wherein said chin cushioning means is made from foam material.

12. The protective helmet apparatus as defined in claim 1 wherein said chin cushioning means is one of a set of liquid filled flexible containers of varying dimensions.

13. The protective helmet apparatus as defined in claim 1 wherein said chin cushioning means is removably attachable to said chin support using adhesive located upon said chin cushioning means.

14. The protective helmet apparatus as defined in claim 1 wherein said chin cushioning means is removably attached to said chin support using hook and loop fabric attached to said helmet casing and said chin cushioning means.

15. The protective helmet apparatus as defined in claim 8 wherein the size of said liquid in said liquid filled flexible containers may be varied by adding or removing the volume of said liquid from said liquid filled flexible container.

16. The protective helmet apparatus as defined in claim 12 wherein said liquid in said set of liquid filled flexible containers may be varied by adding or removing the volume of said liquid from said set of liquid filled flexible containers.

17. The protective helmet apparatus as defined in claim 1 additionally comprising at least one tube passageway communicating through said helmet casing and said chin support.

18. The protective helmet apparatus as defined in claim 1 additionally comprising a rotatable handle mounted upon said helmet casing.

19. A method of fitting a patient for a protective helmet to be worn during surgery comprising:

determining the dimensions of a patient's head;

from a plurality of interchangeable helmet casings, choosing a helmet casing which best accommodates said dimensions of said patient's head;

from a plurality of interchangeable chin supports choosing a chin support which best accommodates said dimensions of said patient's head;

from a plurality of interchangeable ocular cushions choosing an ocular cushion which best accommodates said dimensions;

from a plurality of interchangeable chin supports, choosing a chin cushion which best accommodates said dimensions;

removably attaching said ocular cushion and said chin cushion to said helmet casing and said chin support respectively;

removably attaching said chin support to said helmet casing to form a said helmet apparatus; and removably attaching said helmet apparatus to said patient.

20. The method described in claim 19 also comprising;

questioning said patient as to the comfort of said apparatus and changing one or a combination of a group of components consisting of said helmet casing, said chin support, said ocular cushion, and said chin cushion, whereby maximum comfort and pressure diffusion about the patients face is achieved.

* * * * *